US006092946A

United States Patent [19]

Cockerill et al.

[11] Patent Number: 6,092,946

[45] Date of Patent: Jul. 25, 2000

[54] TAPE PRINTING APPARATUS AND TAPE HOLDING CASE WITH A SLIDING SWITCH

[75] Inventors: Samuel Edward Cockerill; Anthony Roy Dunn, both of Cambridge, United Kingdom

[73] Assignee: Esselte NV, Sint-Niklaas, Belgium

[21] Appl. No.: 09/281,210

[22] Filed: Mar. 30, 1999

[30] Foreign Application Priority Data

Apr. 23, 1998 [EP] European Pat. Off. ..... 98107375

[51] Int. Cl.[7] ..... B41J 2/325

[52] U.S. Cl. ..... 400/613; 400/208; 400/703; 400/708

[58] Field of Search ..... 400/207, 208, 400/613, 594, 903, 708

[56] References Cited

U.S. PATENT DOCUMENTS

| | | | |
|---|---|---|---|
| 4,815,875 | 3/1989 | Richardson et al. | 400/208.1 |
| 5,078,523 | 1/1992 | McCourty et al. | 400/613 |
| 5,374,132 | 12/1994 | Kimura | 400/586 |
| 5,857,788 | 1/1999 | Gutsell et al. | 400/613 |

FOREIGN PATENT DOCUMENTS

| | | |
|---|---|---|
| 0 234 304 | 9/1987 | European Pat. Off. . |
| 0 267 890 | 5/1988 | European Pat. Off. . |
| 0 322 918 | 7/1989 | European Pat. Off. . |
| 0 497 352 | 8/1992 | European Pat. Off. . |
| 0 512 168 | 11/1992 | European Pat. Off. . |
| 0 526 078 | 2/1993 | European Pat. Off. . |
| 0 555 888 | 8/1993 | European Pat. Off. . |
| 0 573 187 | 12/1993 | European Pat. Off. . |
| 0 627 317 | 12/1994 | European Pat. Off. . |
| 0 634 274 | 1/1995 | European Pat. Off. . |
| 0 773 110 | 5/1997 | European Pat. Off. . |
| 2306917 | 5/1997 | United Kingdom . |
| 2309938 | 8/1997 | United Kingdom . |

*Primary Examiner*—John S. Hilten
*Assistant Examiner*—Daniel J. Colilla
*Attorney, Agent, or Firm*—Pennie & Edmonds LLP

[57] ABSTRACT

The invention relates to a combination of a printing device and a tape holding case (10). The printing device comprises a zone for receiving the tape holding case (10) and a slide switch (32) in said zone. The slide switch (32) is movable between at least first and second positions corresponding to a first resp. second type of tape. In order to make the insertion of the tape holding case (10) easier, it is proposed that a tape holding case of the first type is provided with a ramp configured such that the switch (32) is moved into the first position during insertion of the tape holding case (10) into the zone when the switch (32) is originally in the second position. When a tape holding case of a second type is provided, its ramp can move the switch (32) automatically into the second position.

13 Claims, 3 Drawing Sheets

36
10
42
40
3
32
38
34

TAPE PRINTING APPARATUS AND TAPE HOLDING CASE WITH A SLIDING SWITCH

FIELD OF THE INVENTION

The present invention relates to tape printing apparatus and, in particular, is concerned with a tape cassette for use therewith.

DESCRIPTION OF THE RELATED ART

Printing apparatus of the type with which the present invention is generally concerned are known. They operate with a supply of tape arranged to receive an image and a means for transferring the image onto the tape. In one known device, there is a tape holding case which holds a supply of image receiving tape and a supply of an image transfer ribbon, the image receiving tape and the transfer ribbon being passed in overlap through a printing zone of the printing device. At the print zone, a thermal print head cooperates with a platen to transfer an image form the transfer ribbon to the tape. A printing device operating with a tape holding case of this type is described in EP-A-267 890. Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releasable backing layer by a layer of adhesive.

The upper layer can either receive an image on its top surface, its lower surface being secured to the releasable backing layer by a layer of adhesive or alternatively the upper layer can be transparent and can receive an image on one of its faces printed as a mirror image so that it is viewed the correct way round through the other surface of the tape. In this case, a double sided adhesive layer has a releasable backing layer. This latter arrangement is described for example in EPA-0322918.

In another type of printing device described in EP-A-0573187 there are two separate tape holding cases, one holding image receiving tape and the other holding an image transfer ribbon.

With all such printing devices it is desirable that they are able to cooperate with image receiving tape of different widths. For this, the apparatus should include a way of identifying the width of tape within the tape holding case so that printing can be correctly carried out or inhibited where an incorrect tape is inserted. For example, if tape of a narrower width is used, printing should be confined to the area of the narrower width tape and should not extend to a width suitable for a wider tape.

There have been various proposals made to identify the width of tape within a tape holding case. In U.S. Pat. No. 5,078,523 an electrical sensing arrangement is used responsive to different resistive values. Each tape holding case holds a tape of a predetermined width and has a resistor of a predetermined resistive value associated with that width. On insertion of the tape holding case into the printing apparatus, the resistive value is sensed and the width of tape within the tape holding case is thereby identified.

In EP-A-0497352, tape holding cases having tapes of different widths are arranged to actuate different microswitches when inserted into the printing device. Thus, the width of tape is identified by a variation in the external casing of the tape holding case.

In EP-A-0526078, the shape of a tape holding case interacts with an optical sensor to identify the width of tape therein.

In EP-A-0234304, a discriminating switch is provided for discriminating between different colors of ink ribbon. The discriminating switch is only activated when a multi-color ink ribbon is housed in a cassette.

EP-A-0634274 discloses a tape printing device of the type with which the present invention is concerned. On the bottom of the cassette bay in which the tape holding case is received, a slide switch is located, which informs the controller of the tape printing device on the type of tape holding case received, in particular the width of the image receiving tape. Since the tape holding case can only be inserted when the slide switch is in a position corresponding to (and identifying) the tape holding case, the user must set the slide switch into the appropriate position before he can insert the cassette, because it otherwise does not fit into the cassette bay. A similar arrangement is disclosed in GB-A-2309938, according to which the slide switch can identify whether the tape holding case contains a direct thermal printing tape, or a tape for thermal transfer printing. The controller of the printing device can thus adjust the appropriate settings for the printhead energy.

A disadvantage of the cassettes described in the latter two documents is that the user has to set the slide switch manually into the appropriate position before he can insert the tape holding case. Thus, improvements in such devices are needed.

SUMMARY OF INVENTION

The present invention now simplifies the operation of tape printing devices of the type having a slide switch for identifying the type of the tape holding case at the respective receiving portion.

According to the present invention, there is provided in combination, a printing device and a tape holding case which houses a tape for printing, wherein said printing device comprises a zone for receiving the tape holding case and a slide switch in said zone, the slide switch is movable between at least first and second positions, and the holding case is of a first type and provided with a recess configured such that the tape holding case may be received in the zone without interference from the switch if the switch is in the first position, characterized in that the tape holding case of the first type is provided with a means configured such that the switch is moved into the first position during insertion of the tape holding case into the zone when the switch is originally in the second position.

The tape holding case of the first type is thus provided with a means which-during insertion of the case into the receiving zone of the tape printing device-shifts the slide switch into the first position when necessary, i.e. when the switch is not yet in the first position. Should the contrary be the case, i.e. the switch is already in the first position, the means and the switch do not need to interact at all; thus the switch is accommodated in a recess of the tape holding case as known in the state of the art.

The advantage of the invention is thus that the user does not need to set the slide switch manually into the correct position, since this is performed automatically during insertion of the tape holding case. The invention can be used in tape cassettes for use in printing devices which are already in the marketplace.

Further, a tape holding case of a second type housing a tape of a second type different from the type of the first tape is proposed. The tape holding case of the second type is provided with a recess configured such that the tape holding case of the second type may be received in the zone without interference from the switch if the switch is in the second position, and the tape holding case of the second type is provided with a means configured such that the switch is moved into the second position during insertion of the tape holding case of the second type into the zone when the switch is originally in the first position.

Thus, the tape holding case of the second type is similar to the tape holding case of the first type, but symmetric in that it moves the switch from the first to the second position when necessary.

The types of the respective tapes in the tape holding case of the first and second type can have different tape width. Alternatively or additionally, they can have different tape materials (direct thermal material or thermal transfer material, as mentioned in GB-A-2309938) requiring different printhead energies. Alternatively the first type of tape can be material for lamination which is printed upside down (inverse or mirrored), and the second type of tape is directly printed. A distinction between these two types of tape is described in EP-A-0555888, the contents of which is incorporated herein by reference.

According to a second aspect of the invention, there is provided a tape holding case which houses a tape for printing, for use with a printing device, wherein said printing device comprises a zone for receiving the tape holding case and a slide switch in said zone, the slide switch is movable between at least first and second positions, and the holding case is of a first type and provided with a recess configured such that the tape holding case may be received in the zone without interference from the switch if the switch is in the first position, characterized in that the tape holding case of the first type is provided with a means configured such that the switch is moved into the first position during insertion of the tape holding case into the zone when the switch is originally in the second position.

BRIEF DESCRIPTION OF THE DRAWINGS

For a better understanding of the present invention and as to show how the same may be carried into effect, reference will now be made to the accompanying drawings in which.

DETAILED DESCRIPTION OF THE PREFERRED EMBODIMENTS

Figure 1:
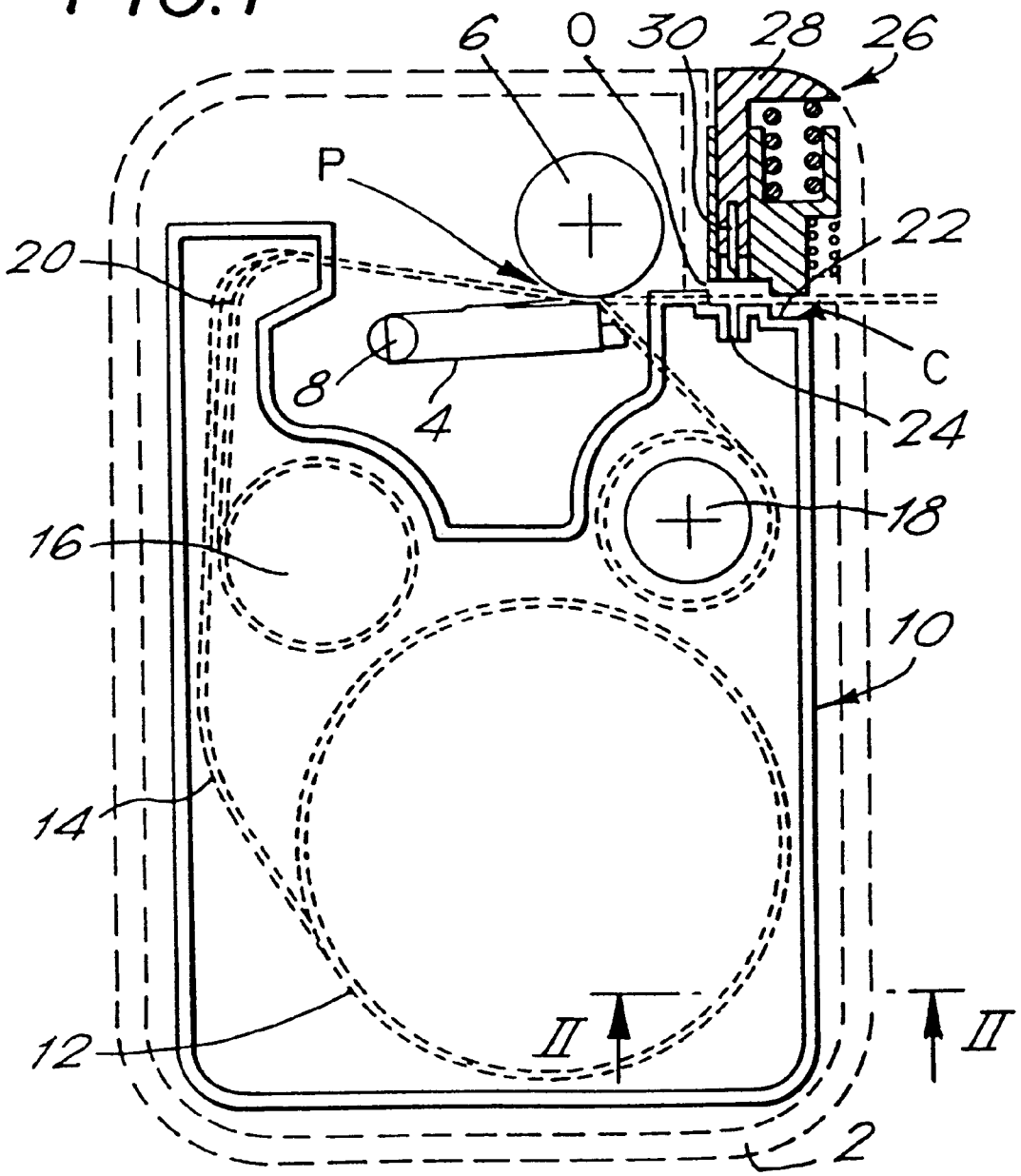
FIG. 1 shows in diagrammatic plan view a printing device with a cassette inserted therein.

FIG. 1 illustrates in plan view a cassette bay of a printing device. The cassette bay is shown by the dotted line 2. The cassette bay includes a thermal print head 4 and a platen 6 which cooperate to define a print location P in a manner which is known in the art. The print head 4 is pivotable around a pivot point 8 so that it can be brought into contact with the platen 6 for printing and moved away from the platen to enable a cassette to be removed and replaced. A cassette inserted into the cassette bay 2 is denoted generally by reference numeral 10. The cassette 10 holds a supply spool 12 of image receiving tape 14 which comprises an image receiving layer secured to a backing layer by a layer of adhesive. The image receiving tape 14 is guided by a guide mechanism (which is not shown) through the cassette 10, out of the cassette through an outlet O, past the print location P to a cutting location C. The cassette 10 also has an ink ribbon supply spool 16 and ink ribbon take up spool 18. The ink ribbon 20 is guided from the ink ribbon supply spool 16 through the print location P and taken up on the ink ribbon take up spool 18. The image receiving tape 14 passes in overlap with the ink ribbon 20 through the print location P with its image receiving layer in contact with the ink ribbon.

In the printing device illustrated in FIG. 1, the platen 6 is driven so that it rotates to drive the image receiving tape 14 past the print location during printing. In this way, tape is printed and fed out from the print location P to the cutting location C. The portion of the wall of the cassette 10 where the cutting location C is defined is denoted by reference numeral 22. A slot 24 is defined in this wall portion and the image receiving tape 14 is fed past the print location P to the cutting location C.

The printing device includes a cutting mechanism denoted generally by reference numeral 26. This cutting mechanism includes a cutter support member 28 which carries a blade 30. The blade 30 cuts the image receiving tape 14 and then enters the slot 24 with the leading part of its edge 31 first, rather than bearing against an anvil. The detailed operation of the cutting mechanism is described in EP-A0627317.

Figure 2:
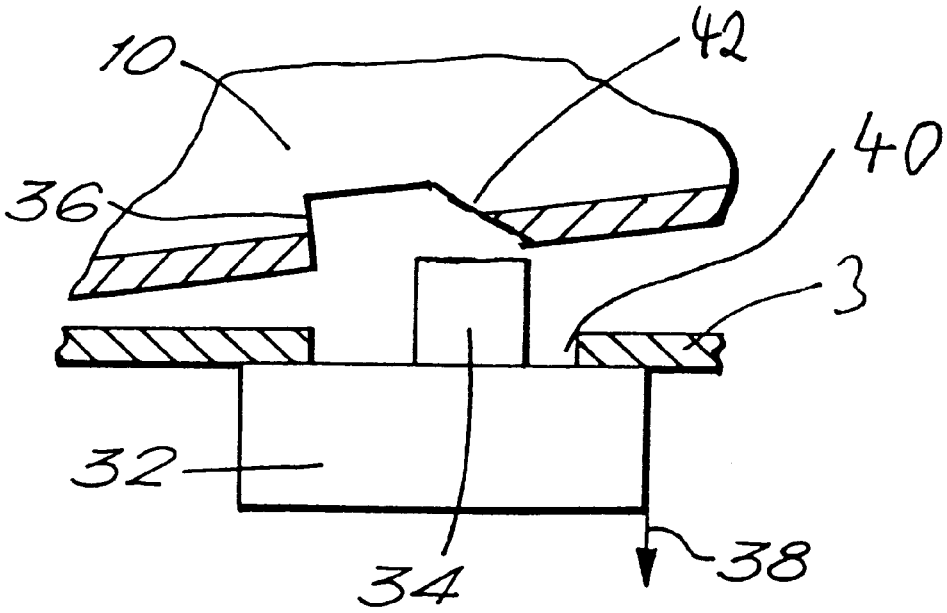
FIG. 2 and 3 are partial sections along line II—II illustrating a tape width selection switch.

FIG. 2 shows a partial diagrammatic section along the line II—II in FIG. 1. In FIG. 2, reference numeral 3 denotes the floor of the cassette bay 2. Reference numeral 10 again denotes a cassette of a first type, for example holding an image receiving tape 14 having a first width of 12 mm. Reference numeral 32 denotes a slide switch and reference numeral 34 denotes an actuating part of the switch. The switch 32 can be a low cost two (or more) position slide switch, conveniently mounted beneath the cassette bay floor 3 through a slot 40. The actuating part 34 of the switch 32 can be slid between a first position (shown in FIG. 3) and a second position, indicating a first state and second state, respectively , as shown in FIG. 2. The cassette 10 of the first type holding a 12 mm width tape has a recess 36 in its underside which is located to accommodate the actuating part 34 of the switch when it is in a first position (this is the position shown in FIG. 3). The switch is connected to an electronic circuit, such as a microprocessor (not shown), via a connection 38 which carries a signal to the microprocessor identifying the position, i.e., position of the actuating member 34 of the switch. The microprocessor then uses this information to determine the type of the tape which, for example, relates to the width of tape which has been selected.

Figure 3:
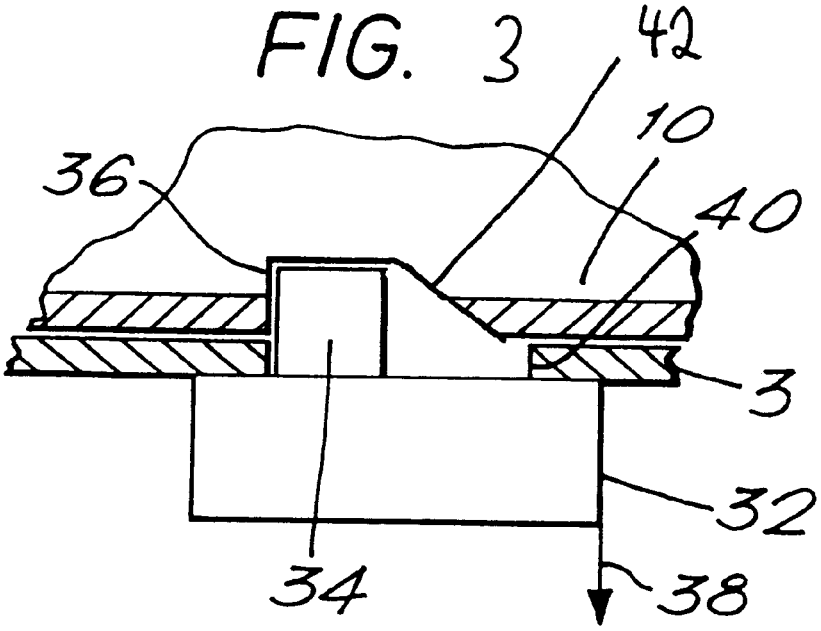

The actuating part 34 of the switch 32 is movable between the second position shown in FIG. 2 and the first position which is shown in FIG. 3. In the first position, it is intended to identify that the first tape width of 12 mm is being used. In the second position, it is intended to identify that a second tape width of, e.g. 6 mm, is being used. Thus, a cassette 10 of the first type (as shown in FIGS. 2 and 3) corresponds to the first position of the switch 32, and a cassette of a second type corresponds to the second position of the switch 32.

In order to avoid that the user has to bring the switch 32 manually into its correct position identifying the width of the tape, the recess 36 in the underside of the cassette 10 of the first type is on its right end shaped in the form of a ramp 42, such that it interacts with the switch 32 and moves the actuating part 34 of the switch 32 into the first position, when the switch is in the second position. This happens while the cassette 10 is being inserted into the cassette bay. The left side of the recess 36 of the cassette 10 of the first type is shaped not to interfere with the actuating part 34 of the switch 32 when the latter is in the first position. The cassette 10 of the first type is thus provided with a recess 36 having a ramp 42 on one side which is formed to move the slide switch 32 into the first position, automatically during insertion of the cassette 10 into the cassette bay 2. This is indicated in FIGS. 2 and 3; due to the interaction of the ramp 42 and the actuating part 34 the switch 32 is moved into the first position while the cassette is inserted.

Figure 4:
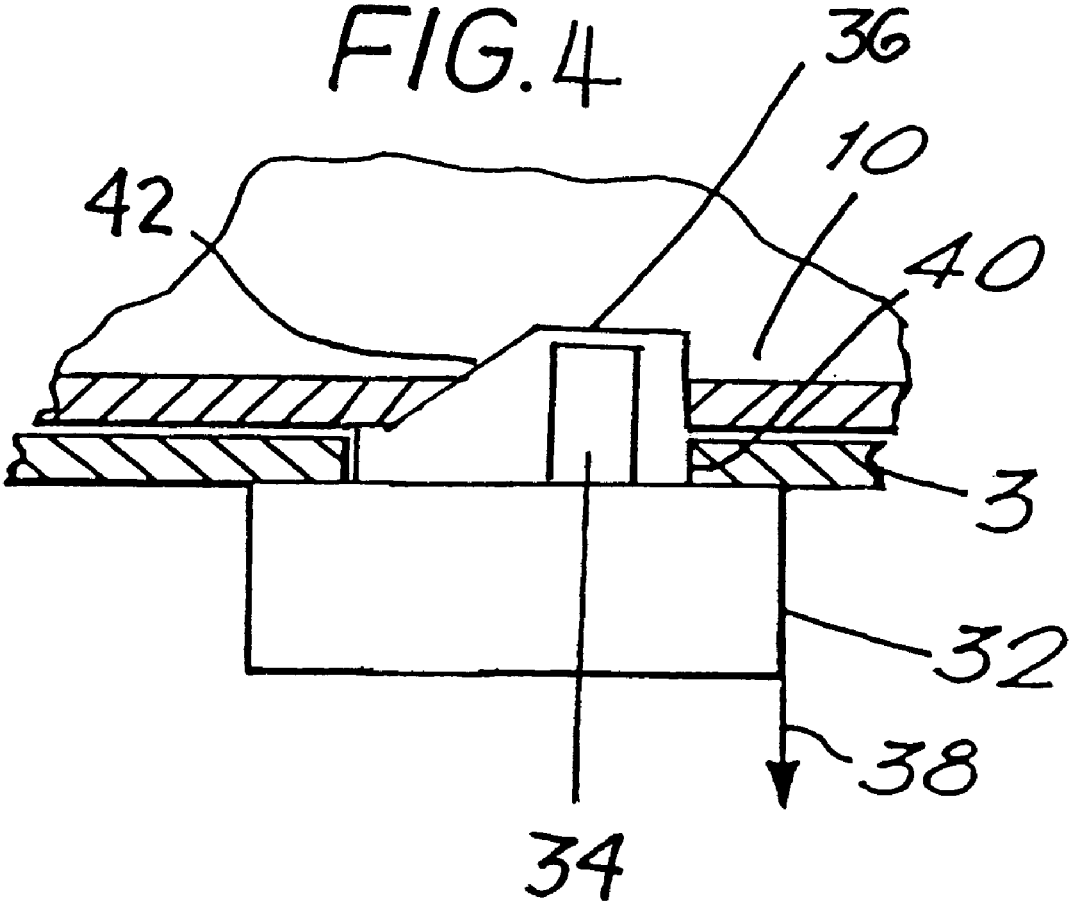

A cassette 10 of the second type (as shown on FIG. 4) would thus have a recess 36 with a rectangular part on the right end, such that it fits over the actuating part 34 of the slide switch 32 when the latter is in the second position, and a ramp 42 for moving the actuating part 34 of the slide switch 32 into the second position, when the switch 32 is in the first position.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A tape printer comprising:

a tape holding case configured to house a printing tape, wherein the printing tape is one of at least first and second types;

a printer device configured to be coupled to the tape holding case, comprising:

a sliding switch configured to be set between at least first and second states, wherein the sliding switch includes an actuating part configured to be moved between at least first and second positions, and wherein the sliding switch is set to the first state when the actuating part is moved to the first position and the sliding switch is set to the second state when the actuating part is moved to the second position; and an electronic circuit configured to determine the type of the printing tape housed in the tape holding case based on the state of the sliding switch when the tape holding case is placed within the printer device; and a printer head configured to print images on the printing tape; and moving means with which to move the actuating part wherein the moving means comprises a recess and an angled ramp configured to move the actuating part to the recess, wherein the location of the recess defines the position of the actuating part.

2. The printer according to claim 1 wherein the electronic circuit is a microprocessor.

3. The printer according to claim 1 wherein the tape of the first type and the tape of the second type differ at least one of tape width, print energy, and printing direction.

4. The printer according to claim 1 wherein the printer device further comprises a tape holding case bay configured to receive the tape holding case.

5. The printer according to claim 4 wherein the sliding switch is located in the bay.

6. A tape holding case comprising:

a printing tape, wherein the printing tape is one of at least first and second types, and moving means configured to interact with a sliding switch of a printer device, wherein the sliding switch is configured to be set between at least first and second states, wherein the sliding switch further comprises an actuating part configured to be moved between at least first and second positions and wherein the sliding switch is set to the first state when the actuating part is moved to the first position and the sliding switch is set to the second state when the actuating part is moved to the second position and, wherein the moving means comprises a recess and an angled ramp configured to move the actuating part to the recess wherein the location of the recess defines the position of the actuating part.

7. The tape holding case according to claim 6 wherein the tape of the first type and the tape of the second type differ at least one of tape width, print energy, and printing direction.

8. A tape printer comprising:

a tape holding case configured to house a printing tape, wherein the printing tape is one of at least first and second types;

a printer device, comprising:

a tape holding case bay configured to receive the tape holding case and having a floor surface;

a sliding switch configured to move laterally by sliding along the floor surface between at least first and second states; and an electronic circuit configured to determine the type of the printing tape housed in the tape holding case based on the state of the sliding switch when the tape holding case is placed within the printer device; and a printer head configured to print images on the printing tape.

9. The printer according to claim 8 wherein the electronic circuit is a microprocessor.

10. The printer according to claim 8 wherein the tape of the first type and the tape of the second type differ at least one of tape width, print energy, and printing direction.

11. The printer according to claim 8 wherein the sliding switch further comprises an actuating part configured to be moved between at least first and second positions, wherein the sliding switch is set to the first state when the actuating part is moved to the first position and the sliding switch is set to the second state when the actuating part is moved to the second position.

12. The printer according to claim 11 wherein the tape holding case further comprises moving means with which to move the actuating part.

13. The printer according to claim 12 wherein the moving means comprises a recess and an angled ramp configured to move the actuating part to the recess, wherein the location of the recess defines the position of the actuating part.

* * * * *